United States Patent [19]

Resech

[11] 4,211,423

[45] Jul. 8, 1980

[54] ROOF SEAL DEVICE

[75] Inventor: Raymond W. Resech, La Grange Park, Ill.

[73] Assignee: Portals Plus, Inc., La Grange Park, Ill.

[21] Appl. No.: 974,435

[22] Filed: Dec. 29, 1978

Related U.S. Application Data

[63] Continuation-in-part of Ser. No. 881,186, Feb. 27, 1978, abandoned.

[51] Int. Cl.[2] ..... F16J 15/02; E04D 13/14

[52] U.S. Cl. ..... 277/212 FB; 285/4; 285/42; 277/1; 277/12

[58] Field of Search ..... 277/1, 12, 212 FB; 285/3, 4, 42–44

[56] References Cited

U.S. PATENT DOCUMENTS

| | | | |
|---|---|---|---|
| 917,167 | 4/1909 | Shaw | 285/43 |
| 2,985,465 | 5/1961 | Church | 285/42 |
| 3,704,894 | 12/1972 | Didszuhn | 277/212 FB |
| 3,807,110 | 4/1974 | Kaminski | 285/44 X |
| 4,010,578 | 3/1977 | Logsdon | 285/44 X |

*Primary Examiner*—Robert S. Ward, Jr.
*Attorney, Agent, or Firm*—John C. Brezina; Van Metre Lund

[57] ABSTRACT

A device is provided including a pair of base sections adapted to be joined together along a generally vertical plane in approximate alignment with a pipe or other object extending through a roof or supported therein, such sections including a pair of molded plastic-supporting parts and a pair of skirt parts of elastomeric material which have overlapping edge portions and which define a downwardly facing surface secured by an adhesive to the upper surface of roofing material to provide a permanent weathertight seal. A split boot is secured to the upper end of a tubular portion of the base sections and is of a stepped, severable construction for accommodating pipes or other objects of various larger sizes. Lips at the split of the boot are secured together by a channel-shaped metal clip. For smaller objects, a split plug is secured on the upper end of the split boot and has inwardly facing annular serrations for sealing engagement with an object. A multi-purpose adaptor plug is also provided for use with a variety of shapes, sizes and orientations of objects.

16 Claims, 14 Drawing Figures

18
10'
14'

18
10"
14"

80
84
81
XI
XI 81
84
82
83

88
86
80
30
85
26
18

50
41
44
42
42a
41a
49
45
46
19
18
45c
46c
23

52
74
73
76
51

18
41a
41'
26
22
25
21
24
20
23
19
27

18
42
42c
42d
42e
42f

ROOF SEAL DEVICE

This application is a continuation-in-part of my copending application, Ser. No. 881,186, filed Feb. 27, 1978, now abandoned.

This invention relates to a roof seal device and more particularly to a device for providing a seal on a roof around a pipe or other object extending through a roof or supported therein. The device is adapted for use in extending pipes through existing roofs as well as in new constructions and is easily installed while providing a permanent weathertight seal.

BACKGROUND OF THE PRIOR ART

Under present roofing practices in which a pitch pocket is used to seal a pipe to a roof opening, leaks are quite common and there is a very high percentage of leaks within the first six months after installation. Sealants crack or run off because of ever-changing weather conditions. Pipe and roofing materials expand and contract with temperature changes and there are also relative movements such as vibrations from wind and/or machinery. If oftentimes happens that leaks are not discovered until after substantial damage has occurred, making major repairs necessary.

Roof curb devices have been provided for obtaining a proper seal but have generally be designed for new construction or during installation of a new roof and they are difficult to install and not at all suitable for extending a pipe through an existing roof.

SUMMARY OF THE INVENTION

This invention was evolved with the general object of overcoming the disadvantages of prior art sealing methods and devices and of providing a device which will provide a permanent weatherproof seal and which is readily installed in both existing and new construction.

In accordance with this invention, a pair of complementary base sections are provided, each including a support part of a molded, strong and substantially rigid plastic material and a skirt part of a flexible elastomeric material on the support part. The sections are arranged to be secured together along a generally vertical plane through a roof opening and together they provide an upstanding tubular portion and a peripheral flange portion with the skirt parts providing a downwardly facing surface engageable with the upper surface of roofing material about a pipe or other object extending through a roof or supported therein. An adhesive material bonds such engaging surfaces together and a permanent weatertight seal is provided.

The flexibility of the skirt parts promotes conformity to irregularities in the upper surface of the roofing material and also allows for relative expansions and contractions such as those due to temperature changes. Preferably and in accordance with a specific feature, the skirt parts are formed with offsets in a manner such as to provide an annular wall portion outside the periphery of the support parts, for additional flexibility.

Another specific feature relates to the provision of sections of adhesive material on the undersides of the edges of the support parts for holding the skirt parts on the roof during application of an adhesive between the peripheries of the skirt parts and the roof surface.

Seal means are secured to the upper end of the upstanding tubular portion defined by the base sections, preferably including a split boot of flexible elastomeric material which is most preferably of a stepped, severable construction for accommodating pipes or other cylindrical objects of various larger sizes. For objects of smaller sizes, a split annular plug is secured on the upper end of the boot, the plug having an opening of a size matched to that of the small object to be sealed and serrated tooth formations are provided in such opening.

Important features of the invention relate to the construction of the split boot and to the manner of installing the boot on the base sections. A pair of lip portions are provided at the split of the boot and are pressed together by a clip of generally channel-shaped configuration which is preferably formed with notches to conform to the stepped configuration of the boot and which is severable according to the size of the pipe.

In accordance with a specific feature, the clip is formed with tooth portions which bite into grooves in the lip portions in a manner and as to insure a highly reliable sealed connection.

Additional features relate to the construction of the plug which includes an outwardly extending annular flange or in an alternate construction, it includes a downwardly facing annular groove receiving an uppermost tubular portion of the stepped boot with tongue and groove means and overhanging flap means being provided at the split of the plug.

Another very important feature relates to a multipurpose adaptor plug which is so arranged as to receive a mastic and to provide a seal around an object or a plurality of objects of a variety of configurations. It may be used for example, for a plurality of pipes, one or more angle irons or for square tubes, objects extending at angles, etc.

Still another feature relates to the provision of annular ribs on the inside of the tubular portion of the base for engagement with the outside of a sheet metal chimney which may be nailed to a roof in new constructions. The device is thus suitable for installation during new construction as well as on existing roofs and can accommodate pipes of a wide range of sizes. It should be understood that the device can be used in conjunction with any elongated object similar to a pipe and the term "pipe" is used herein in a generic sense to include any equivalent type of object.

This invention contemplates other objects, features and advantages which will become more fully apparent from the following detailed description taken in conjunction with the accompanying drawings.

DESCRIPTION OF A PREFERRED EMBODIMENT

Figures 1, 2, 3, 4, 5:
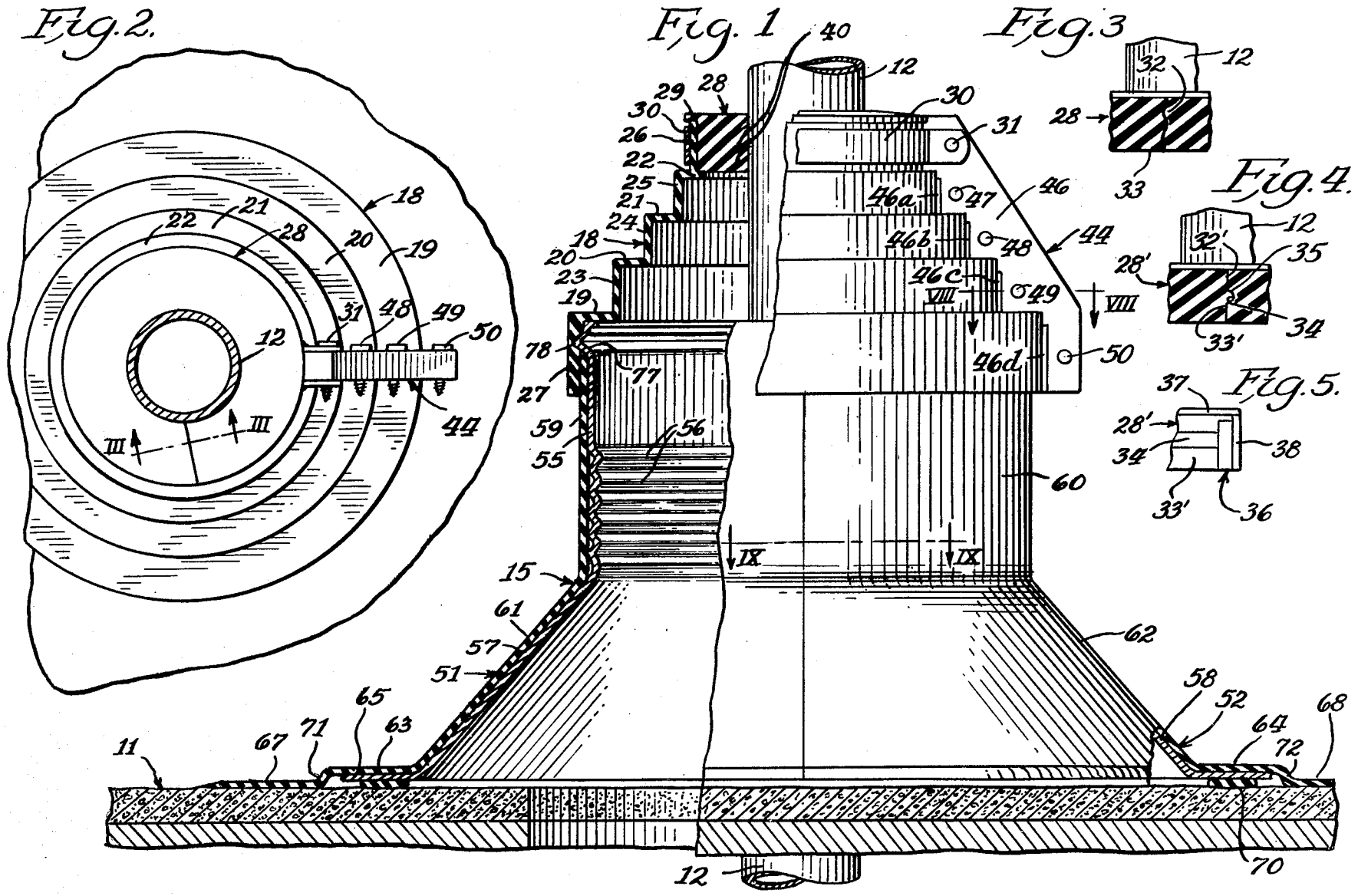
FIG. 1 is a side elevational view, partly in section, illustrating a device constructed according to the invention installed on a roof to provide a seal to a pipe.
FIG. 2 is a top plan view of the device.
FIG. 3 is a sectional view taken substantially along line III—III of FIG. 2 and showing an interface at the split of a plug of the device.
FIG. 4 is a view similar to FIG. 3, showing an alternative construction.
FIG. 5 is a view of one face of the split of the alternative plug construction of FIG. 4.

Reference numeral 10 generally designates a roof seal device constructed in accordance with the principles of this invention, and shown installed on a roof 11 to provide a seal to a pipe 12 which extends through an opening 13 in the roof 11. The device 10 is designed for installation on an existing roof to replace a defective seal or for installation on an existing roof after extending a pipe through a new opening cut therethrough. It may be used for objects other than pipes, for objects which project upwardly from a roof without extending therethrough. It may also be used in new construction as hereinafter described. Once installed, it provides a permanent waterproof seal.

The device 10 comprises a base generally designated by reference numeral 14 and including a pair of complementary base sections 15 and 16 which are adapted to be joined together along a generally vertical plane in approximate alignment with an object projecting upwardly from a roof, the plane being through the roof opening 13 in the illustrated arrangement. Sections 15 and 16 together provide an upstanding generally tubular portion and a peripheral portion for engagement with the roof surface about the opening therein. Pipe seal means are secured to the upper end of the base and include a split boot 18 of a flexible elastomeric material which preferably has a plurality of annular step portions 19–22 in vertically spaced planes and tubular portions 23–26 progressively smaller diameters joining the inner edge of each of the step portions and the outer edge of the next higher step portion. An additional tubular portion 27 extends around the upper end of the base. The boot 18 is severable along the top edge of a selected one of the tubular portions 23–27 which has a diameter matching that of a pipe within a larger size range, such as from 3½ to 6 inch pipe, for example. For smaller sizes of pipe, a split annular plug 28 is provided.

The plug 28 has an outwardly projecting annular flange 29 which overlies the uppermost tubular portion 26 of the boot 18 and a clamp 30 is disposed around the tubular wall portion 26, a screw 31 being extended through the ends of the clamp 30. As shown in FIGS. 2 and 3, the split of the plug 28 provides two interengaging faces 32 and 33 which are formed on a bias, i.e. at an angle to a radial plane and which are of mating form with alternating grooves and ridges.

In the alternative as shown in FIGS. 4 and 5 a modified plug 28' may be used including a face 32' having a groove 34 receiving a tongue 35 on a face 33'. The modified plug 28' may be formed with a downwardly facing annular groove 36 which receives the uppermost tubular portion 26 of the boot 18, within the clamp. An integral flap portion 37 projects from the upper side of the face 33' and overlies a portion of the plug 28', adjacent the face 32'. In addition, a flap portion 38 is provided on the outside projecting from the outer side of the face 33' and on the outside of a portion of the plug adjacent the face 32'.

Another feature of the plug 28 is in the provision of annular serrations 40 in the central opening of the plug for engagement with the outside surface of the pipe and to improve the sealing action. The serrations are formed by downwardly facing annular surfaces which are at relatively large angles relative to the horizontal and upwardly facing surfaces which are horizontal or at relatively small angles to the horizontal.

It should be noted that the pipe 12 as illustrated is a conventional pipe, but the plug 28 can be used for other types of objects such as angle and channel-shaped members, for example, and the opening in the plug can be shaped as desired or a multi-purpose plug can be used as hereinafter described in connection with FIGS. 10–12. Also, of course, the openings for pipes should have a size corresponding to the outer diameter of the pipe, and, for example, a plurality of plugs may be supplied for pipe sizes of three inches, two and one-half inches, two inches, one and one-half inches, one and one-quarter inches, one inch, three-quarter inch, one-half inch and three-eights inch. The upper face of the plug, as shown, should have a slight pitch.

The boot 18 at the split therein includes a pair of outwardly projecting interengaging lip portions 41 and 42, the portion 41 having a groove **41*a* therein which receives an integral tongue 42*a* formed on the lip 42. The lips 41 and 42 are secured together by a generally channel-shaped clip 44 including side walls 45 and 46 which are formed with notches which register with each other and with the projections formed by the step and tubular portions of the boot. The screw 31, which secures the clamp 30 in place, may also extend through the upper ends of the side walls of the clip 44 and additional screws 47, 48, 49 and 50 have shank portions extended through openings in side wall 45 thence through openings in the lips 41 and 42 and thence into openings in the side wall 46**.

An additional feature of the clip 44 is in the provision turned-in portions **45*a*, 45*b*, 45*c* and 45*d* on wall 45 and turned-in portions 46*a*, 46*b*, 46*c* and 46*d* on wall 46 which form teeth engaged in notches in the lip portions 41 and 42. Thus as illustrated in FIG. 7, the outer face of the lip portion 42 is formed with grooves 42*c*, 42*d*, 42*e* and 42*f* receiving the teeth 46*a*, 46*b*, 46*c* and 46*d* and the lip portion 41 is formed with similar grooves receiving the teeth 45*a*–45*d***.

When the boot 18 is severed for use with a larger size of pipe, the clip 44 is correspondingly severed.

The base sections 15 and 16 include supporting parts 51 and 52 which are of molded, strong and substantially rigid plastic material, preferably an acrylonitrite butadiene styrene material, and skirt parts 53 and 54 of a flexible elastomeric material, preferably an ethylene propylene hydrocarbon material. A portion 55 of the supporting part 51 and a corresponding portion of the other supporting part 52 together provide a generally tubular portion of the base and such portions are preferably formed to provide annular rib formations 56 which are provided for engagement with the outside surface of a chimney which may preferably be formed of sheet metal and secured to a roof opening, such being used in new construction. For use on existing construction, the rib formations 56 do not engage such a chimney device but they are nevertheless advantageous in reinforcing and rigidifying the supporting parts 51 and 52.

The supporting part 51 further includes a portion 57 which together with a corresponding portion 58 of the other supporting part 52 provide a generally frusto-conical support portion.

The skirt parts 53 and 54 include portions 59 and 60 which together define a generally tubular portion surrounding the tubular portion formed by portion 55 of the supporting part 51 and the corresponding portion of supporting part 52. The skirt parts 53 and 54 further include frusto-conical portions 61 and 62 disposed on the outside of portion 57 of part 51 and the corresponding portion 58 of part 52.

In addition, the skirt parts 53 and 54 include portions 63 and 64 disposed against the upper surfaces of outwardly projecting annular flange portions 65 and 66 and parts 51 and 52.

On the outside of the portions 63 and 64, the skirt parts 53 and 54 include peripheral portions 67 and 68 which are bonded to the upper surface of the roof 11 through a suitable adhesive. Prior to installation, an adhesive strip 69 is secured to the underside of the peripheral flange portion 65 of the supporting part 51 and a corresponding adhesive strip 70 is secured to the underside of the corresponding flange portion 66 of the part 52, such adhesive strips being protected by a suitable release paper which is removed prior to installation so that the device can be accurately positioned on the roof, after which the adhesive is supplied between the lower surfaces of portions 67 and 68 of the skirt parts 53 and 54 and the upper surface portions of the roof.

An important feature is in the provision of wall portions 71 and 72 between the portions 63,64 and 67,68 which provide an offset to accommodate the thicknesses of the flange portion 65 and adhesive strip 69 and the corresponding flange portion and adhesive strip on the opposite side. The portions 71 and 72 are also very important in permitting a flexibility such as to accommodate shifts in position as encountered in the extreme temperature and other environmental conditions to which roof structures are subjected.

Figures 6, 7, 8, 9, 10, 11, 12, 13, 14:
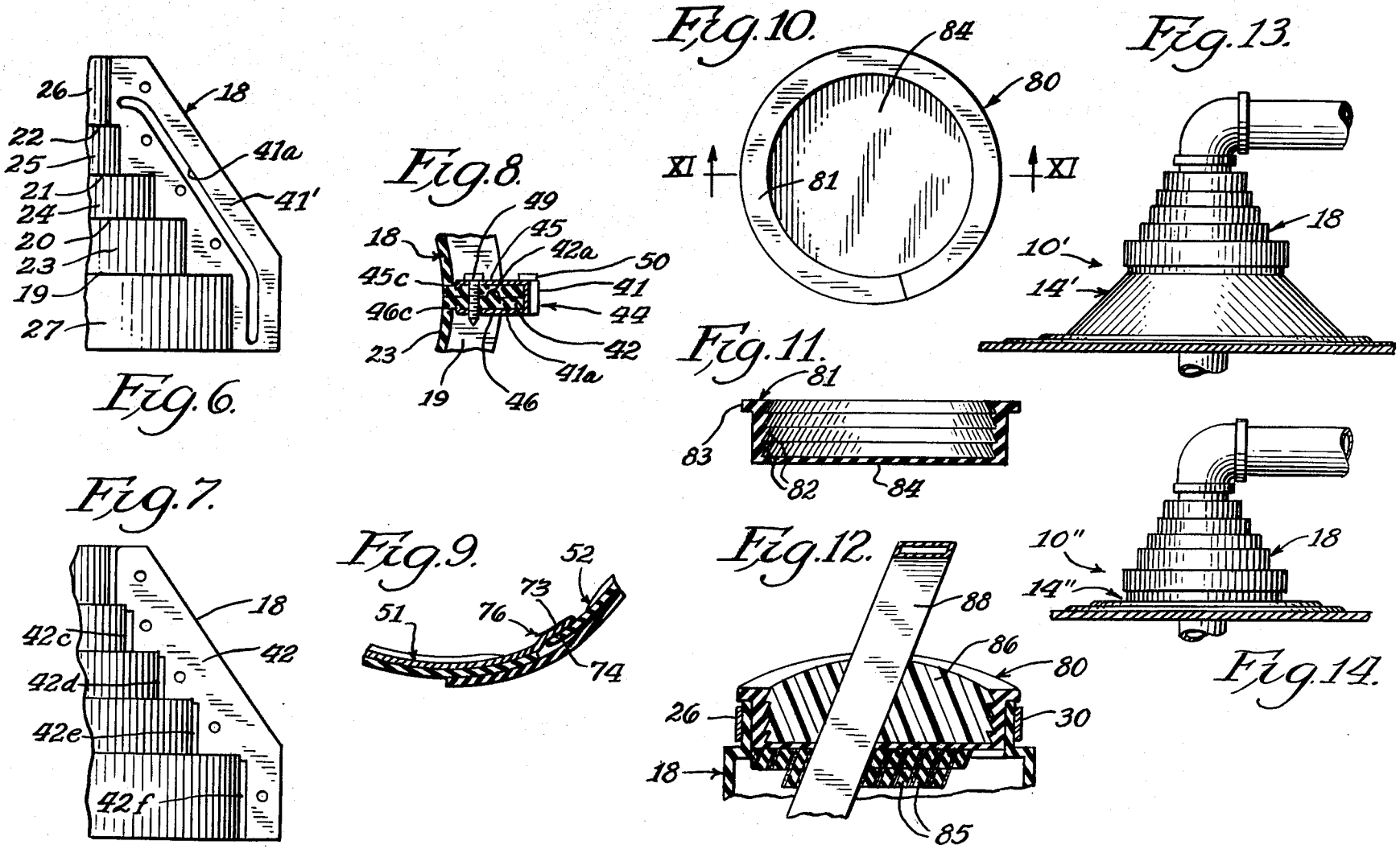
FIG. 6 is a view illustrating an inner face of one lip portion of a split boot of the device.
FIG. 7 is a view illustrating an outer face of a second lip portion of the split boot of the device.
FIG. 8 is a sectional view taken substantially along line VIII—VIII of FIG. 1.
FIG. 9 is a sectional view taken substantially along line IX—IX of FIG. 1.
FIG. 10 is a top plan view of a multi-purpose adaptor plug according to the invention.
FIG. 11 is a sectional view taken substantially along line XI—XI of FIG. 10.
FIG. 12 is a perspective view, partly in section, illustrating how the adaptor plug of FIGS. 10 and 11 is used and installed.
FIG. 13 is a side elevational view illustrating a modified base configuration which has an intermediate height profile.
FIG. 14 is a side elevational view illustrating another modified base configuration which has a low profile.

FIG. 9 shows how edge portions of the two base sections 15 and 16 are secured together. On one side, the supporting part 51 of base section 15 has an edge portion 73 which is offset radially inwardly to extend on the inside of an edge portion 74 of the supporting part 52 of the base section 16. Such edge portions are secured together through a plurality of metal clips one of which is designated by reference numeral 76 in FIG. 9. The clip 76 is of generally S-shaped configuration and the edge portion 73 is lockeld between inner and intermediate portions thereof while edge portion 74 is locked between intermediate and outer portions thereof, such inner, intermediate and outer portions being preferably formed with integral struck-out tooth portions for biting and locking engagement with the edge portions 73 and 74. The same arrangement is used on the other side but with the edge portion of the supporting part 52 being offset inwardly to extend on the inside of the supporting part 51, the supporting parts 51 and 52 thus having the same configuration. Preferably, at least three metal clips are used on each side, one adjacent the top of the generally cylindrical portion of the base, another adjacent the junction between the cylindrical and frusto-conical portions and a third adjacent the lower and outer end of the frusto-conical portion. Prior to assembly each supporting part may carry clips along the edge portion at one side thereof, in position to receive the mating edge portion of the other supporting part.

As shown in FIG. 1, the lowermost tubular portion 27 of the boot 18 has an inwardly facing annular groove 77 which receives an outwardly projecting annular rib or tongue portion 78 of the supporting part 51, a similar annular rib or tongue portion being provided on the other supporting part 52.

When the device is used in connection with extending pipes through or in mounting an object on an existing roof, or in replacing defecting seals around pipes or other objects, the device is preferably provided with the adhesive strips 69 and 70 and with strips of a protective release paper on the undersides of such adhesive strips. As a preliminary step, the roof surface around a pipe or other object to be sealed is prepared to provide a smooth and firm surface with gravel and dirt being swept away in all directions by means of a brush which may be desirable supplied with the device. Also, the two base sections are brought together around the pipe or other object, the edge portions of the supporting parts 51 and 52 being locked together through the clips 76 as above described. Then after removing the strips of release paper from the undersides of the adhesive strips 69 and 70, the base is carefully centered relative to the pipe or other object and is pressed down against the roof, preferably by stepping down on the portions 63 and 64, the adhesive strips 69 and 70 being then effective to securely hold the base in the proper position relative to the pipe or other projecting object.

After so mounting the base, the installer lifts an extending side flap portion of each of the skirt parts 53 and 54 which overlaps a side edge of the other and applies an adhesive between such flap and side edge portion, firmly pressing them together to provide a reliable seal. The user also lifts the peripheral edge portions 67 and 68 of the skirt parts 53 and 54, applies an adhesive between the undersides of such edge portions and the roof surface portions therebelow and then presses the portions 67 and 68 against the roof surface portions to provide a reliable seal.

The boot 18 is then installed and, if desired, an adhesive is applied between interengaging surfaces of the lip portions 41 and 42 after which the clip 44 is installed with the screws 47–50 being inserted and tightened to firmly clamp the lip portions 41 and 42 together.

If the device is used with a pipe or other cylindrical object having a diameter greater than that corresponding to the upper tubular portion 26 of the boot 18, the boot 18 is cut at the upper edge of the appropriate one of the tubular portions 23–25 prior to installation, the clip 44 is also cut at a corresponding level and a clamp similar to clamp 30 is installed around such tubular portion.

If the device is used with a pipe or other cylindrical object having a diameter corresponding to the upper tubular portion 26, the clamp 30 is used to clamp the portion 26 directly to the pipe or other object.

If the device is used with a pipe or other object having a size less than that corresponding to the upper tubular portion 26, the plug 28 is used, being installed in a position as shown after which the clamp 30 is installed with the screw being tightened.

It is noted that the plug 28 may be formed with a central opening having a shape such as to receive projecting objects which do not have cylindrical shapes, such as square objects, angle irons, etc. It is also possible to use a multi-purpose adaptor plug arrangement as illustrated in FIGS. 10–12, forming an important feature of the invention. An adaptor plug 80 is provided including a split annular wall portion 81 having an outside cylindrical surface engageable with the inner surface of the uppermost tubular portion 26 of the boot 18 and having an internal surface formed with serrations 82 similar to the serrations 40 of the plug 28. An integral projecting annular flange 83 is provided, similar to the flange 29 of the plug 28 and for the same purpose.

The adaptor plug 80 additionally has a bottom 84 which may preferably be quite thin. In use, the plug 80 is positioned on the top of the boot 18 and the bottom 84 is cut, with a razor blade for example, to an extent necessary to permit the plug to be fully inserted in the upper end of the boot 18 and around one or more pipes or other projecting objects. After marking the position of the bottom 84 relative to the projecting object or objects, the plug is temporarily removed and, as shown in FIG. 12, a special thick adhesive tape 85 is wrapped around the projecting object or objects at a level such as to provide support for the bottom 84 when the plug 80 is then reinserted in the boot. Next a mastic 86 is applied into the plug to fill the space around the projecting object or objects and within the annular wall portion 81.

In FIG. 12, the projecting object is shown as being a square tube 86 extending at an angle but it will be understood that the arrangement can be used with a wide variety of shapes, orientations and members of projecting objects. It is also noted that the plug 80 is not limited to use in connection with a split boot and split base arrangement as illustrated but may be used with non-split boots as in new construction, for example.

It is noted that the roof seal device 10 as illustrated in FIG. 1 has what may be described as a high height profile which is desirable for most applications but a modified device 10', FIG. 13, having an intermediate height profile may be used in some applications and another modified device 10'', FIG. 14, having a low height profile may be used in other applications. Device 10'' may be used, for example, in providing a seal around a pipe which projects to an elbow only a short distance above the level of a roof.

In all three devices 10, 10' and 10'' the size of the boot 18 is the same and it projects just slightly less than 4 inches above the top of the curb or base 14, 14' or 14''. In FIG. 1 the height of the curb or base 14 is 8 inches; in FIG. 13, the height of the base 14' is 5 inches; and in FIG. 14, the height of the base 14'' is only 1½ inches. In both FIGS. 1 and 13, the overall diameter, including the skirt flange portions 67 and 68 is 20.5 inches and in the low profile base 14'' of FIG. 14 it is reduced to 13.625 inches it being noted that the low profile base has no frusto-conical portion. These dimensions are given by way of illustrative example and are not to be construed as limitations except that dimensions and proportions of the same order as described and illustrated are of some importance for obtaining optimum use and performance of the devices.

It is noted that in new construction, the base sections may be secured together prior to use and a sheet metal chimney may be nailed to the new roof about an opening therein after which the base may be inserted on the chimney so secured in position. The device is thus extremely versatile, being usable for both existing and new constructions and being adapted to receive pipes or other objects of a wide variety of sizes and configurations.

It will be understood that modifications and variations may be effected without departing from the spirit and scope of the novel concepts of this invention.

I claim as my invention:

1. In a device for providing a weather-tight seal on a roof around an object projecting upwardly therefrom, a pair of complementary base sections adapted to be joined together along a generally vertical plane in approximate alignment with said object and together providing an upstanding generally tubular portion for surrounding the object and a peripheral flange portion extending outwardly from the lower end of said tubular portion for engaging the upper surface of roofing material about said object, seal means secured to the upper end of said tubular portion for sealing engagement with said object, each of said complementary base sections including a supporting part of a molded, strong and substantially rigid plastic material and a skirt part of a flexible elastomeric material on said support part, each of said skirt parts having edge portions arranged for overlapping interfitting engagement with edge portions of the skirt part of the other section, said skirt parts having peripheral edge portions together providing a downwardly facing surface adapted to engage an annular portion of the upper surface of roofing material about said object, and an adhesive material for sealing and bonding said downwardly facing surface of said skirt parts to said upper surface of said roofing material.

2. In a device as defined in claim 1, said skirt parts being formed of an ethylene propylene hydrocarbon material adapted to withstand temperatures varying over a wide range and adapted to be sealingly secured through said adhesive to the upper surfaces of roofs including both tarred and shingled roofs.

3. In a device as defined in claim 2, said supporting parts being of an acrylonitrite butadiene styrene material.

4. In a device as defined in claim 1, said pipe seal means including a split boot of a flexible elastomeric material for accommodating relative movements of the pipe and roof due to expansion and contraction from heat and cold and to vibrations.

5. In a device as defined in claim 4, said split boot having a pair of engagable lip portions along the split thereof, and a generally channel-shaped metal closure clip arranged to be pressed into said engagable lip portions to press said lip portions together and to provide mechanical support therefor.

6. In a device as defined in claim 4 for use with a cylindrical object, said split boot having a plurality of annular step portions in vertically spaced planes and tubular portions of progressively smaller diameters joining the inner edge of each step portion and the outer edge of the next higher step portion, said boot being severable along the top edge of a selected tubular portion having a diameter matching that of said object.

7. In a device as defined in claim 6, said split boot having a pair of engagable lip portions along the split thereof, and a generally channel-shaped metal closure clip arranged to be pressed onto said engagable lip portions to press said lip portions together and to provide mechanical support therefor, said clip being severable to match the severence of said boot in matching the diameter of said object.

8. In a device as defined in claim 7, said clip including parallel side walls having registering notches for receiving and interfitting with said step and tubular portions and being severable at the bottom of each notch.

9. In a device as defined in claim 6, a split annular plug defining a central opening for receiving an object having a transverse dimension less than the diameter of the smallest diameter upper end tubular portion of said boot.

10. In a device as defined in claim 9, said split plug having a downwardly facing annular groove receiving said upper end tubular portion of said boot, having at the split thereof mating radially extending tongue and groove means and overhanging flap means, and having inwardly facing annular serrations in said opening for sealing engagement with the object.

11. In a device as defined in claim 8, said clip having pairs of opposed tooth portions adapted to bite into said lip portions adjacent the outer surfaces of said tubular portions.

12. In a device as defined in claim 1, said supporting parts having outwardly extending peripheral edge portions, adhesive means on the underside of said outwardly extending peripheral edge portion of said supporting parts for securing said supporting parts to said roof, said peripheral edge portions of said skirt parts extending outwardly beyond said peripheral edge portions of said supporting parts for providing said downwardly facing surface of said skirt parts.

13. In a device as defined in claim 12, said skirt parts having portions together defining an annular wall projecting upwardly from inner edges of said peripheral edge portions of said skirt parts on the outside of said peripheral edge portions of said supporting parts.

14. In a device as defined in claim 1, said seal means including a plug having a split annular wall adapted to encircle an object and having a relatively thin bottom wall adapted to be cut for extension of the object therethrough, said plug being adapted to be filled with a mastic material.

15. In a device for providing a weather-tight seal on a roof about an object projecting upwardly therefrom, seal means for providing a seal between the object and the upper end of a tubular portion which surrounds the object, said seal means including a plug having a split annular wall adapted to encircle an object and having a relatively thin bottom wall adapted to be cut for extension of the object therethrough, said plug being adapted to be filled with a mastic material.

16. In a device as defined in claim 15, adhesive tape means adapted to be wrapped around the object below said bottom for support of said bottom during filling of said plug with a mastic material.

* * * * *